US009114611B2

(12) United States Patent
Ike

(10) Patent No.: US 9,114,611 B2
(45) Date of Patent: Aug. 25, 2015

(54) PRINTING APPARATUS AND INK DISCHARGE STATE DETERMINATION METHOD

(71) Applicant: CANON KABUSHIKI KAISHA, Tokyo (JP)

(72) Inventor: Takeshi Ike, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/219,504

(22) Filed: Mar. 19, 2014

(65) Prior Publication Data

US 2014/0300657 A1 Oct. 9, 2014

(30) Foreign Application Priority Data

Apr. 3, 2013 (JP) ..... 2013-078092

(51) Int. Cl.
*B41J 2/05* (2006.01)
*B41J 2/125* (2006.01)
(Continued)

(52) U.S. Cl.
CPC ..... *B41J 2/125* (2013.01); *B41J 2/0451* (2013.01); *B41J 2/0458* (2013.01); *B41J 2/04563* (2013.01); *B41J 2/05* (2013.01); *B41J 2/14153* (2013.01); *B41J 2002/14354* (2013.01)

(58) Field of Classification Search
CPC .. B41J 2/04563; B41J 2/0458; B41J 2/04541; B41J 2/04591; B41J 2002/14354; B41J 2/365; B41J 2/125; B41J 2/05
USPC ..... 347/14, 17, 19, 20, 44, 56, 57
See application file for complete search history.

(56) References Cited

U.S. PATENT DOCUMENTS 6,644,774 B1 * 11/2003 Burger et al. ..... 347/19
7,690,751 B2 4/2010 Takabayashi et al.
(Continued)

FOREIGN PATENT DOCUMENTS

CN 1078685 5/1993
CN 101092074 12/2007
(Continued)

OTHER PUBLICATIONS

Search Report issued in European Patent Application No. 14159375.6, dated Jul. 11, 2014.
(Continued)

*Primary Examiner* — Thinh Nguyen
(74) *Attorney, Agent, or Firm* — Fitzpatrick, Cella, Harper & Scinto

(57) ABSTRACT

An embodiment of this invention is directed to determination of the ink discharge state of a printhead capable of accurately determining the discharge state of each nozzle while suppressing increases in the size and cost of an apparatus. In the embodiment, the ink discharge state of a printing apparatus including a printhead including a heater for discharging ink and a temperature sensor, and a driving unit configured to drive the heater is determined as follows. It is controlled to drive the heater by applying the first voltage for discharging ink, and drive the heater by applying the second voltage enough not to discharge the ink. Whether ink is normally discharged or discharge failure has occurred is determined based on information obtained from detected plural temperatures in regard to the application timing of the second voltage.

11 Claims, 10 Drawing Sheets

(51) Int. Cl.
*B41J 2/045* (2006.01)
*B41J 2/14* (2006.01)

(56) References Cited

U.S. PATENT DOCUMENTS

| | | | |
|---|---|---|---|
| 7,806,503 | B2 | 10/2010 | Aoki et al. |
| 8,186,798 | B2 | 5/2012 | Aoki et al. |
| 8,287,082 | B2 | 10/2012 | Aoki et al. |
| 8,579,407 | B2 | 11/2013 | Yabe |
| 8,733,876 | B2 | 5/2014 | Ike |
| 2009/0085946 | A1 | 4/2009 | Aoki et al. |
| 2010/0321441 | A1 | 12/2010 | Aoki et al. |
| 2012/0306953 | A1 | 12/2012 | Kanno et al. |
| 2013/0135381 | A1 | 5/2013 | Ike |

FOREIGN PATENT DOCUMENTS

| | | | |
|---|---|---|---|
| CN | 101092082 | | 12/2007 |
| CN | 102133815 | | 7/2011 |
| JP | 7-52408 | A | 2/1995 |
| JP | 2008-000914 | A | 1/2008 |
| JP | 2009-083227 | A | 4/2009 |

OTHER PUBLICATIONS

U.S. Appl. No. 14/224,496, filed Mar. 25, 2014, naming Takeshi Ike.

* cited by examiner

NORMAL DISCHARGE
DISCHARGE FAILURE

STATE i
STATE ii
STATE iii
103
104
105

PRINTING APPARATUS AND INK DISCHARGE STATE DETERMINATION METHOD

BACKGROUND OF THE INVENTION

1. Field of the Invention

The present invention relates to a printing apparatus and ink discharge state determination method, and particularly to a printing apparatus using a printhead including a heating element (heater) for discharging ink, and an ink discharge state determination method.

2. Description of the Related Art

Of inkjet printing methods of discharging an ink droplet from a nozzle to attach it to paper, a plastic film, or another printing medium, there is an inkjet printing method using a printhead including a heater which generates heat energy to discharge ink. For a printhead complying with this method, for example, an electrothermal transducer which generates heat in accordance with energization, a driving circuit for it, and the like can be formed using the same process as a semiconductor manufacturing process. This printhead has advantages in which, for example, high density integration of nozzles is easy and high printing resolution can be achieved.

In this printhead, an ink discharge failure sometimes occurs in all or some nozzles of the printhead owing to a cause such as clogging of a nozzle by a foreign substance, highly viscous ink, or the like, a bubble entering an ink supply channel or nozzle, or a change of the wettability of the nozzle surface. To avoid degradation of the image quality when such discharge failure occurs, it is desirable to quickly execute a recovery operation of recovering an ink discharge state, or a complementary printing operation using another nozzle or the like. However, to quickly perform these operations, it is very important to accurately, appropriately determine an ink discharge state and occurrence of discharge failure.

There have conventionally been proposed various ink discharge state determination methods, complementary printing methods, and apparatuses to which these methods are applied.

Japanese Patent Laid-Open No. 2009-083227 discloses a method of detecting an ink flow in a channel that is generated when discharging ink, in order to detect an ink discharge failure. In Japanese Patent Laid-Open No. 2009-083227, the discharge state is determined using the fact that the ink flow is small upon occurrence of discharge failure, compared to normal discharge. As the method of detecting an ink flow, Japanese Patent Laid-Open No. 2009-083227 discloses a method of regarding an ink flow as heat transfer of ink and detecting a change of the temperature of heat-applied ink, and an arrangement in which a sensor for detecting a temperature is arranged in the channel or nozzle.

Japanese Patent Laid-Open No. 2008-000914 discloses a method of detecting a temperature drop generated in normal discharge in order to detect discharge failure. According to Japanese Patent Laid-Open No. 2008-000914, in normal discharge, a point at which the temperature drop rate changes appears a predetermined time after a detected temperature reaches a maximum temperature. However, when discharge failure occurs, this point does not appear. By detecting the presence/absence of this point, the ink discharge state is determined. Japanese Patent Laid-Open No. 2008-000914 also discloses an arrangement in which a temperature detector is arranged below a heater configured to generate heat energy for discharge. As a method of detecting the presence/absence of the point, Japanese Patent Laid-Open No. 2008-000914 also discloses a method of detecting the point as a peak value by differential processing.

However, the discharge state determination method disclosed in Japanese Patent Laid-Open No. 2009-083227 utilizes a difference in ink flow, and the detector is arranged at a location spaced apart from the heater. Thus, a large difference is hardly occurred between normal discharge and discharge failure, resulting in poor detection accuracy. Further, the detector includes the heating element for adding heat to ink. This complicates and upsizes the printing apparatus, raising the apparatus cost.

In the arrangement disclosed in Japanese Patent Laid-Open No. 2008-000914, the detector is arranged below the heater, so a change between normal discharge and discharge failure is easily detected. However, the temperature drop phenomenon occurs upon contact of a very tiny ink droplet generated in normal discharge, so a large difference is hardly generated between normal discharge and discharge failure. Since the point at which the temperature drop rate changes in normal discharge appears at the timing of a temperature drop, it is difficult to accurately detect the point. As a result, the detection accuracy degrades.

SUMMARY OF THE INVENTION

Accordingly, the present invention is conceived as a response to the above-described disadvantages of the conventional art.

For example, a printing apparatus and ink discharge state determination method according to this invention are capable of accurately, appropriately determining the discharge state of each nozzle and occurrence of discharge failure while suppressing increases in the size and cost of the apparatus.

According to one aspect of the present invention, there is provided a printing apparatus comprising: a printhead including a heater configured to generate heat energy for discharging ink, and a temperature sensor configured to detect a temperature; a driving unit configured to drive the heater; a control unit configured to control to drive the heater by the driving unit by applying a first voltage for discharging ink, and drive the heater by applying a second voltage enough not to discharge the ink; and a determination unit configured to determine, based on information obtained from a plurality of temperatures detected by the temperature sensor in regard to an application timing of the second voltage, whether ink is normally discharged or discharge failure has occurred.

According to another aspect of the present invention, there is provided an ink discharge state determination method in a printing apparatus including a printhead including a heater configured to generate heat energy for discharging ink and a temperature sensor configured to detect a temperature, and a driving unit configured to drive the heater. The method comprises: controlling to drive the heater by the driving unit by applying a first voltage for discharging ink, and drive the heater by applying a second voltage enough not to discharge the ink; and determining, based on information obtained from a plurality of temperatures detected by the temperature sensor in regard to an application timing of the second voltage, whether ink is normally discharged or discharge failure has occurred.

The invention is particularly advantageous since the ink discharge state of each nozzle can be accurately determined while suppressing increases in the size and cost of the apparatus.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "printing element" (to be also referred to as a "nozzle" hereinafter) generically means an ink orifice or a liquid channel communicating with it, and an element for generating energy used to discharge ink, unless otherwise specified.

<Description of Printing Apparatus (FIG. 1)>

First, an inkjet printing apparatus (to be referred to as a printing apparatus hereinafter) commonly applicable to several embodiments to be described later will be explained.

Figure 1:
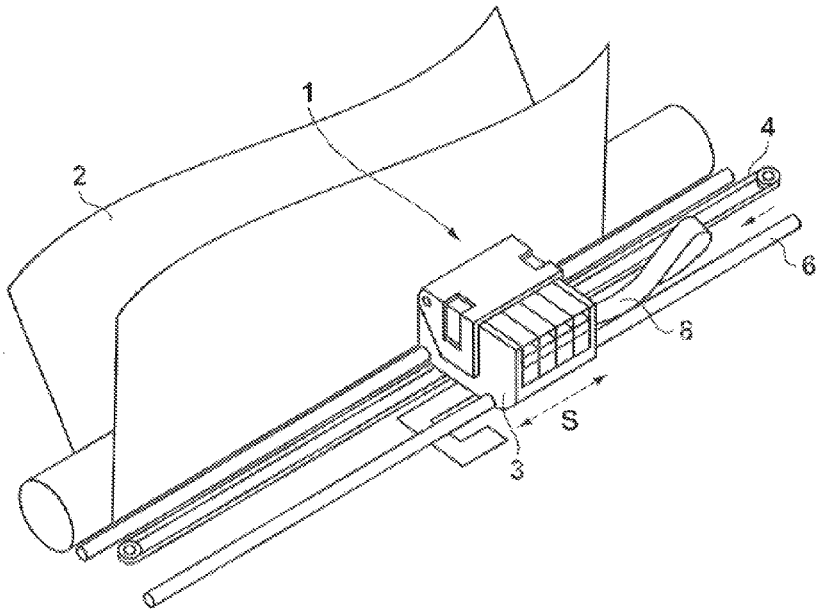
FIG. 1 is a perspective view showing the main mechanism of an inkjet printing apparatus as an exemplary embodiment of the present invention.

FIG. 1 is a perspective view showing, as an exemplary embodiment of the present invention, the outline of the main mechanism of the printing apparatus in which an inkjet printhead (to be referred to as a printhead hereinafter) is mounted to discharge ink to a printing medium and print. As shown in FIG. 1, a printhead 1 is mounted on a carriage 3. The carriage 3 is guided and supported to be reciprocal in directions indicated by an arrow S along a guide rail 6 in accordance with the movement of a timing belt 4. The printhead 1 includes, on a surface opposing a printing medium 2, nozzles arrayed in a direction different from the moving direction of the carriage 3. While the carriage 3 supporting the printhead 1 is reciprocally scanned in the directions indicated by the arrow S, ink is discharged from the nozzles of the printhead 1 in accordance with print data, thereby printing on the printing medium 2.

A plurality of printheads 1 can be arranged in consideration of discharge of inks of a plurality of colors. For example, the printheads 1 can print using inks of cyan (C), magenta (M), yellow (Y), and black (Bk). The printhead 1 may be integrated with an ink tank storing ink, to be separable or inseparable. The printhead 1 may receive supply of ink via a tube or the like from an ink tank arranged at a fixed portion of the apparatus. The carriage 3 includes an electrical connection for transferring a driving signal or the like to each printhead 1 via a flexible cable 8 and a connector.

Although not shown in FIG. 1, a recovery unit used to maintain the ink discharge operation of the nozzles of the printhead in a satisfactory state or recover it is arranged outside the printing range for the printing medium 2 within the moving range of the printhead. The recovery unit can adopt a well-known arrangement. For example, the recovery unit can include a cap which caps the nozzle formation surface of the printhead, and a pump which forcibly discharges ink from the nozzles into the cap by applying a negative pressure in the capping state. The recovery unit may perform discharge (preliminary discharge) of ink not contributing to image printing into, for example, the cap.

<Arrangement of Printhead (FIGS. 2A-3)>

Figure 2A:
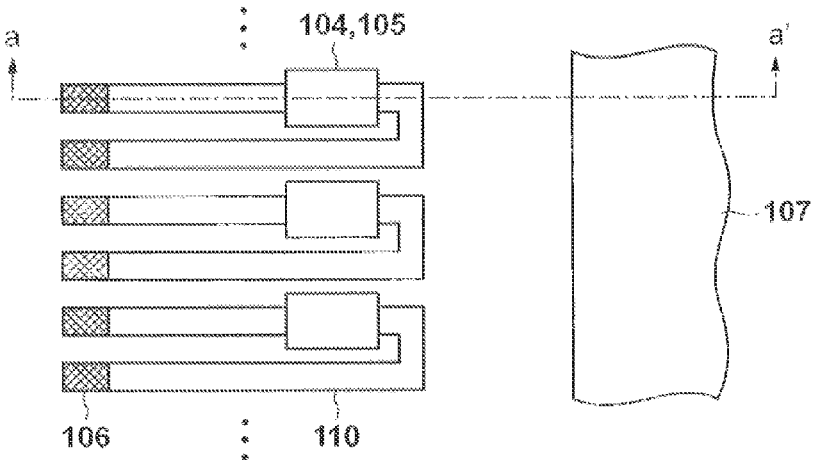
FIGS. 2A and 2B are a schematic plan view showing part of the substrate (heater board) of an inkjet printhead including a temperature detection element, and a schematic sectional view taken along a line a-a', respectively.
Figure 2B:
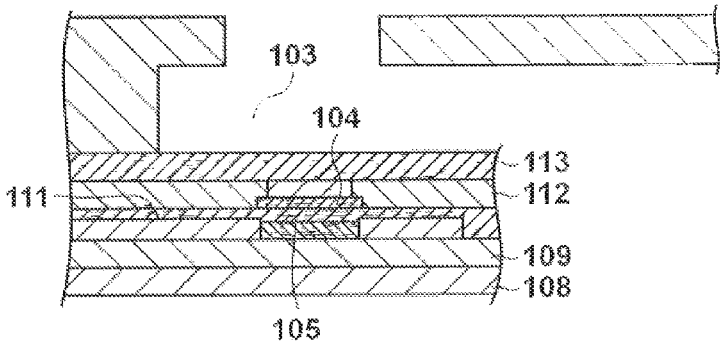

FIG. 2A is a schematic plan view showing part of the substrate (heater board) of the printhead including a temperature detection element. FIG. 2B is a schematic sectional view taken along a line a-a'.

Electric power is supplied in accordance with a driving pulse signal to discharge ink from a plurality of arrayed nozzles 103. In response to this, electrothermal transducers (to be referred to as heaters hereinafter) 104 are heated to cause, for example, film boiling in ink, thereby discharging ink droplets from the respective nozzles.

In the plan view of FIG. 2A, terminals 106 are connected to the outside by wire bonding to supply power. Temperature detection elements (to be referred to as temperature sensors hereinafter) 105 are formed on the heater board by the same film forming process as that for the heaters 104. Reference numeral 107 denotes a common liquid chamber.

As shown in the sectional view of FIG. 2B, the temperature sensor 105 formed from a thin film resistor whose resistance value changes in accordance with the temperature is arranged on a heat accumulation layer 109 made of a thermal oxide film of $SiO_2$ or the like on an Si substrate 108 forming the heater board. The temperature sensor 105 is made of Al, Pt, Ti, Ta, Cr, W, AlCu, or the like. Further, an interconnection 110 of Al or the like including an individual interconnection for the heater 104 and an interconnection connected to the heater and a control circuit for selectively supplying power to the heater 104 is formed on the Si substrate 108. Further, the heater 104, a passivation film 112 of SiN or the like, and an anti-cavitation film 113 are stacked on an interlayer insulation film 111 at high density by a process similar to a semiconductor manufacturing process. Note that Ta or the like can be used for the anti-cavitation film 113 in order to enhance the cavitation resistance on the heater 104.

The temperature sensors 105 each formed as a thin-film resistor are arranged immediately below (adjacent to) the corresponding heaters 104 in one-to-one correspondence so that the temperature sensors 105 are independently separated and are equal in number to the heaters 104. The heater 104 can be constituted as part of the individual interconnection 110 connected to each temperature sensor 105. This is advantageous in production because the heater board can be manufactured without greatly changing a conventional structure.

Figure 3:
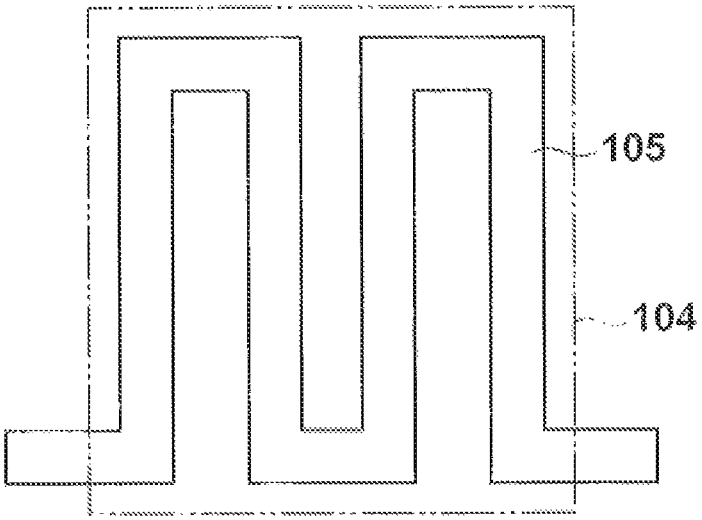
FIG. 3 is a schematic plan view showing an example of another shape of a temperature sensor which can be formed on the heater board shown in FIGS. 2A and 2B.

The planar shape of the temperature sensor 105 can be determined appropriately. The planar shape of the temperature sensor 105 may be a rectangular shape having the same dimensions as those of the heater 104, as shown in FIG. 2A, or a serpentine shape, as shown in FIG. 3. Such a shape can increase the resistance of the temperature sensor 105, and a detection value can be obtained at high accuracy even from a small temperature fluctuation.

<Control Arrangement (FIG. 4)>

Figure 4:
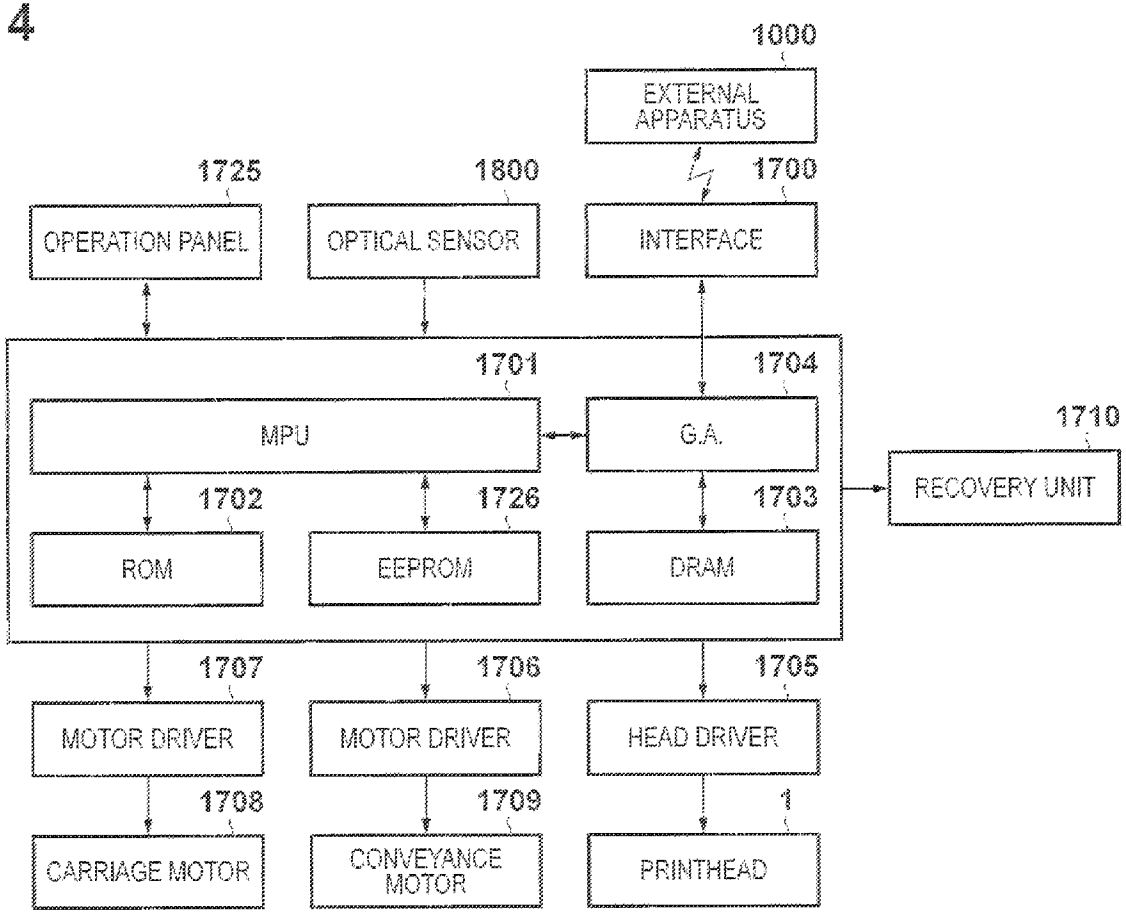
FIG. 4 is a block diagram showing the control arrangement of a printing system including the printing apparatus shown in FIG. 1.

FIG. 4 is a block diagram showing the control arrangement of a printing system including the printing apparatus shown in FIG. 1.

In FIG. 4, an interface 1700 receives print signals containing commands and image data sent from an external apparatus 1000 having the form of a host computer or another appropriate form. The printing apparatus can send status information of the printing apparatus from the interface 1700 to the external apparatus 1000, as needed. An MPU 1701 controls respective units in the printing apparatus in accordance with control programs corresponding to processing procedures (to be described later) and necessary data, which are stored in a ROM 1702.

A DRAM 1703 saves various data (for example, the print signal, and print data to be supplied to the printhead). A gate array (G.A.) 1704 controls supply of print data to the printhead 1, and also controls data transfer between the interface 1700, the MPU 1701, and the DRAM 1703. A nonvolatile memory 1726 such as an EEPROM saves necessary data even upon power-off of the printing apparatus.

A carriage motor 1708 is used to reciprocate the carriage 3 in the directions indicated by the arrow, as shown in FIG. 1. A conveyance motor 1709 is used to convey the printing medium 2. A head driver 1705 drives the printhead 1. Motor drivers 1706 and 1707 drive the conveyance motor 1709 and carriage motor 1708, respectively. A recovery unit 1710 can include the above-mentioned cap, pump, and the like. An operation panel 1725 includes a setting input unit used by an operator to make various settings for the printing apparatus, and a display unit which displays a message to the operator. An optical sensor 1800 detects the conveyance position of the printing medium, and the like.

<Discharge State Determination Principle>

The printhead to which the present invention is applied basically includes a heating element (heater) which generates heat energy to discharge ink, and a temperature detection element (temperature sensor) which detects a temperature change along with driving.

In a method according to the first embodiment to be described later, first, a voltage which causes neither bubbling nor discharge is applied in the period of the time when ink contacts the anti-cavitation film after bubbling in normal discharge, or the time when ink contacts the anti-cavitation film after bubbling upon occurrence of discharge failure. This application will be called the second application, and this voltage will be called the second voltage. To discriminate, from the second application, application of a voltage for discharging ink, this application will be called the first application, and this voltage will be called the first voltage.

Then, if the difference between a temperature immediately before applying the second application and a temperature a predetermined time after applying the second voltage is smaller than a predetermined threshold based on a temperature change detected by the temperature detection element, it is determined that discharge is normal.

As a method according to the second embodiment (to be described later), if a value obtained by performing second order differential for a temperature change after applying the second voltage is larger than a predetermined value, it is determined that discharge is normal.

Discharge Phenomenon and Temperature Change in Normal Driving

The relationship between a state change in the nozzle and a change of the temperature detected by the temperature sensor in a case in which ink is normally discharged and a case in which discharge failure has occurred will be explained. First, the state of ink in the nozzle and a change of the temperature detected by the temperature sensor when the second voltage is not applied will be described as a comparative example of the present invention.

FIGS. 5A to 5G are views showing the state of ink in the nozzle in a case in which ink is normally discharged and a case in which discharge failure has occurred when the second voltage is not applied, that is, only the first voltage is applied.

Figure 6:
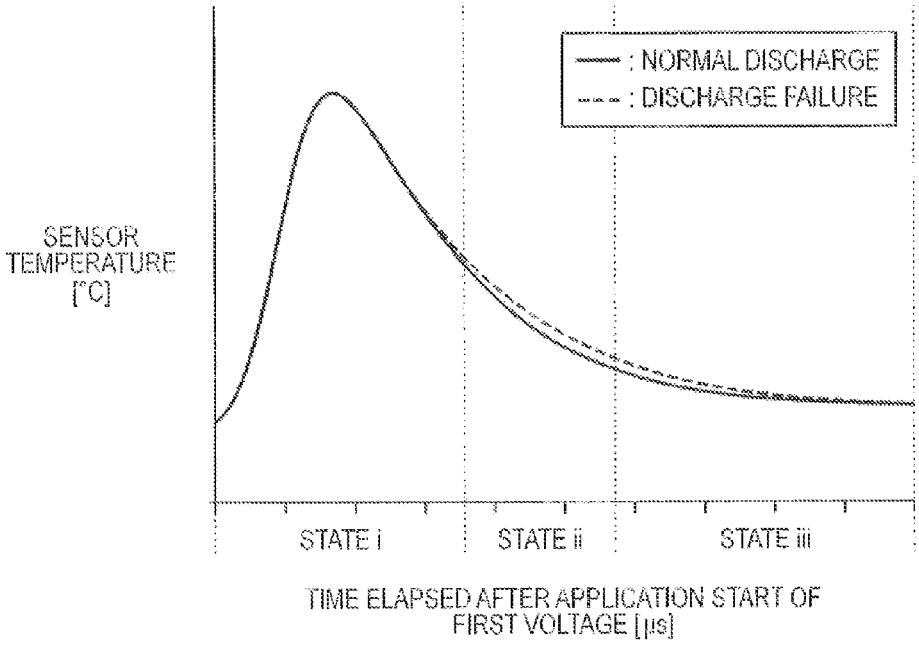
FIG. 6 is a graph showing a change of the temperature detected by a temperature sensor 105 in a case in which ink is normally discharged and a case in which discharge failure has occurred when the second voltage is not applied.

FIG. 6 is a graph showing a change of the temperature detected by the temperature sensor 105 in a case in which ink is normally discharged and a case in which discharge failure has occurred when the second voltage is not applied, that is, only the first voltage is applied.

Figures 5A, 5B, 5C, 5D, 5E, 5F, 5G:
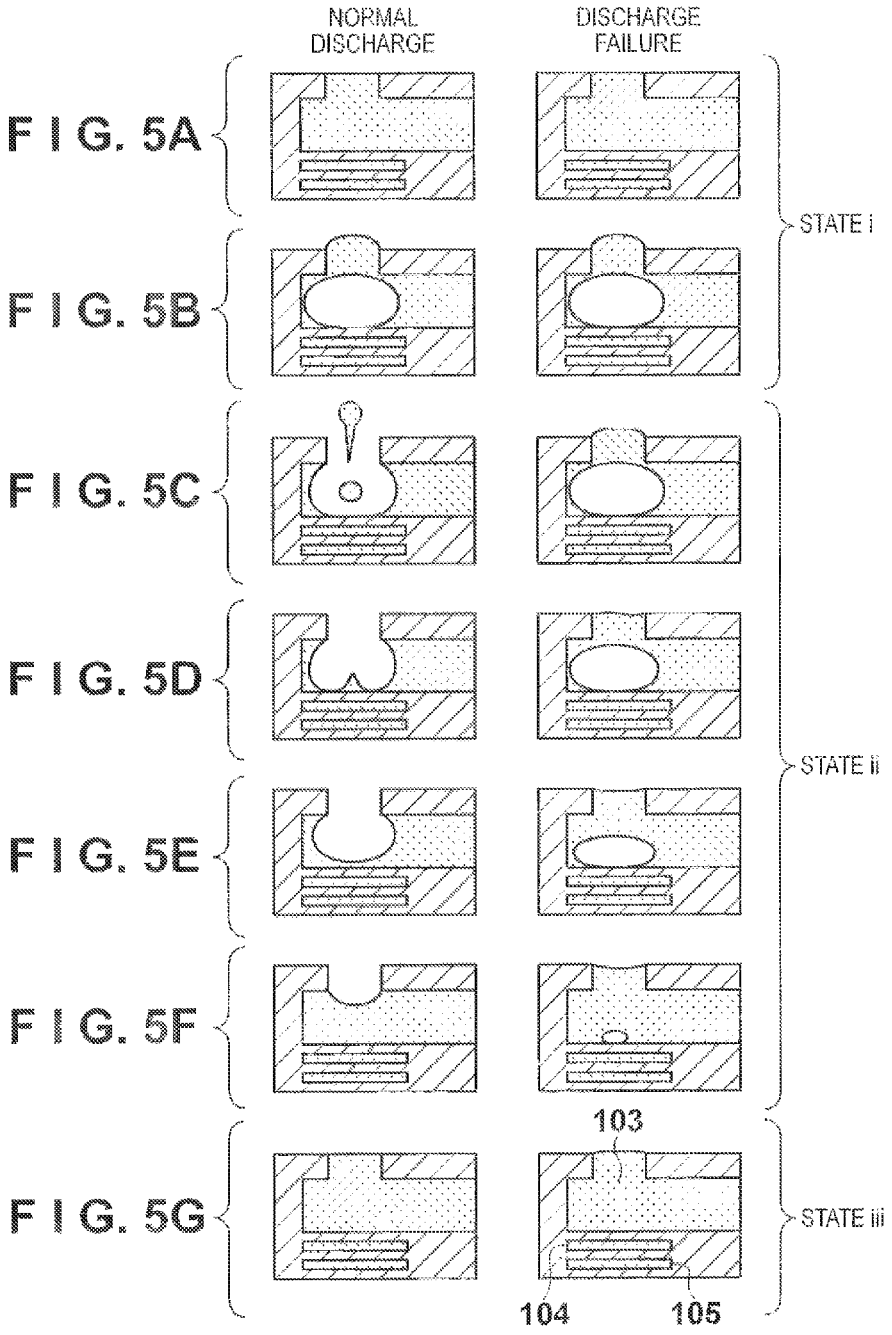
FIGS. 5A, 5B, 5C, 5D, 5E, 5F, and 5G are views showing the state of ink in a nozzle in a case in which ink is normally discharged and a case in which discharge failure has occurred when the second voltage is not applied.

In FIG. 6, the ordinate represents the temperature (° C.) detected by the temperature sensor, and the abscissa represents the time (the unit is μsec) elapsed after the first voltage is applied. In FIGS. 5A to 6, the states of ink in the nozzle are categorized into a state i, state ii, and state iii along the elapsed time.

[State i]

When a pulse-like voltage is applied to the heater 104, the temperature of the heater 104 abruptly rises (see FIG. 5A). Along with this, the temperature at the interface between ink and the anti-cavitation film also rises. When the temperature at the interface between ink and the anti-cavitation film reaches an ink bubbling (boiling) temperature, a bubble is generated and grows. At this time, a portion of the anti-cavitation film 113 immediately above the heater 104 does not contact ink owing to generation of the bubble (see FIG. 5B). Since the heat conductivity of the bubble is lower by one order of magnitude than that of ink, heat is hardly conducted toward the ink in the state in which the bubble exists immediately above the heater 104. After the application of the voltage pulse stops, the temperature detected by the temperature sensor 105 reaches the maximum temperature and then drops.

[State ii]

The course of a temperature drop and the state of ink in the nozzle after the temperature detected by the temperature sensor 105 reaches the maximum temperature are different between normal discharge and discharge failure. Thus, the course of a temperature drop and the state of ink in the nozzle will be explained separately for normal discharge and discharge failure.

1. Normal Discharge

As heat is dissipated, the bubble shrinks gradually. The internal pressure of the bubble and the atmosphere pressure become different, causing an ink flow from the orifice to the bubble and heater board. As a result, a satellite ink droplet (trailing ink) generated when ink above the center of the bubble or the bubble communicates with the atmosphere contacts the anti-cavitation film 113 before the bubble completely disappears (see FIG. 5C). Since the ink of high heat conductivity contacts the anti-cavitation film 113, heat is conducted from the heater board to the ink, and the temperature sensor 105 on the heater board side is rapidly cooled (see FIG. 5D). In response to this, the cooling rate changes in the course of a drop of the temperature detected by the temperature sensor 105. After the cooling rate changes, the ink always covers the anti-cavitation film (see FIG. 5E). The ink flows soon from the ink supply port to fill the inside of the nozzle (see FIG. 5F), and the temperature detected by the temperature sensor 105 drops.

2. Discharge Failure

If dust is clogged in the nozzle or the viscosity of ink near the nozzle increases, the ink cannot be discharged in some cases (see FIG. 5C). Since a grown bubble does not cause even an ink flow by discharge, the phenomenon in which only ink above the center of the bubble contacts the anti-cavitation film 113 does not occur. In the course of a drop of the temperature detected by the temperature sensor 105, the cooling rate does not change, unlike normal discharge. The grown bubble disappears soon over time, and the interface between the ink and the anti-cavitation film gradually shrinks (see FIGS. 5D and 5E). When the bubble disappears completely, the anti-cavitation film 113 is covered with the ink (see FIG. 5F). At this time, since the ink of high heat conductivity contacts the anti-cavitation film 113, heat is conducted from the heater board to the ink, and the temperature sensor 105 on the heater board side is rapidly cooled. In response to this, the cooling rate changes in the course of a drop of the temperature detected by the temperature sensor 105. After the cooling rate changes, the ink always covers the anti-cavitation film, and the temperature detected by the temperature sensor 105 drops.

[State iii]

The temperature drops to a value detected immediately before applying the first application voltage, and becomes constant (see FIG. 5G).

<First Embodiment>

An ink discharge phenomenon and a change of the temperature detected by a temperature sensor when a printhead is driven by applying the second voltage according to the first embodiment of the present invention will be explained.

Figure 7:
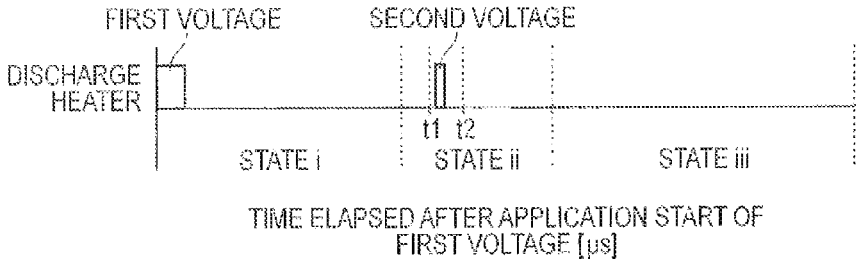
FIG. 7 is a timing chart showing timings when the second voltage is applied and the temperature sensor detects a temperature in the first embodiment.

FIG. 7 is a timing chart showing timings when the second voltage is applied and the temperature sensor detects a temperature in the first embodiment.

As shown in FIG. 7, the timing when the second voltage is applied is the period (state ii) of the time when ink contacts an anti-cavitation film after bubbling in normal discharge, or the time when ink contacts the anti-cavitation film after bubbling upon occurrence of discharge failure. The magnitude of energy applied by the second voltage is small enough not to bubble or discharge ink. When the second voltage is applied, a change of the temperature detected by the temperature sensor becomes different between normal discharge and discharge failure of ink.

Figure 8:
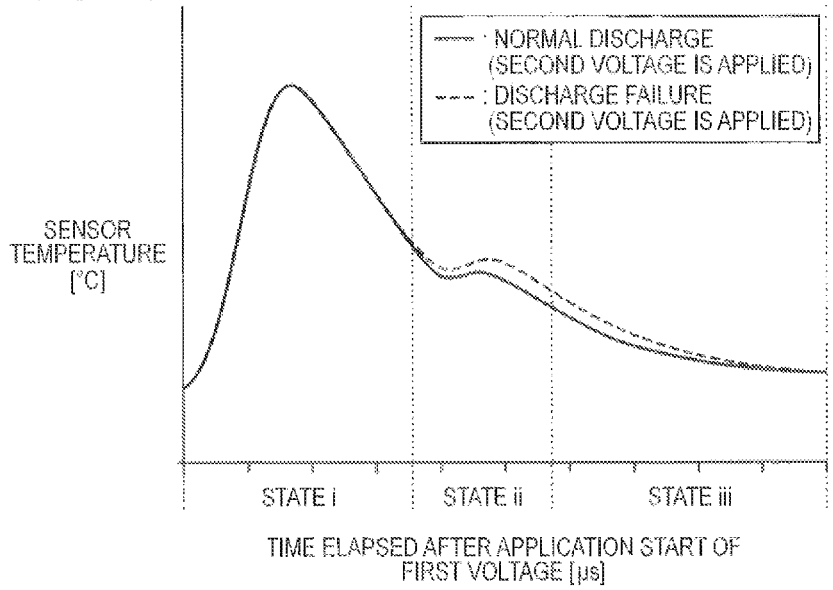
FIG. 8 is a graph showing temperature changes in a case in which ink is normally discharged and a case in which discharge failure has occurred when the second voltage is applied.

FIG. 8 is a graph showing a temperature change in normal discharge of ink and occurrence of discharge failure when the second voltage is applied.

In normal discharge, ink of high heat conductivity covers the anti-cavitation film. Thus, heat generated by the second voltage is mainly conducted toward the ink, and the heat generated by the second voltage is hardly conducted to the temperature sensor. As a result, the temperature detected by the temperature sensor hardly rises. In contrast, upon occurrence of discharge failure, a bubble of low heat conductivity covers the heater surface. The heat generated by the second voltage is hardly conducted toward the bubble and readily conducted to the temperature sensor. Accordingly, the temperature detected by the temperature sensor rises.

Next, the temperature detection timing, threshold setting, and ink discharge state determination method will be explained.

As represented in FIG. 7, inspection start time t1 serving as the timing when temperature detection by a temperature sensor 105 starts is immediately before applying the second voltage. A temperature measured at this timing will be called a first temperature Tp1. Also, inspection end time t2 serving as the timing when the temperature detection by the temperature sensor 105 ends is the timing when the difference between normal discharge and discharge failure of ink appears in the temperature detected by the temperature sensor after applying the second voltage. A temperature measured at this timing will be called a second temperature Tp2.

Figure 9:
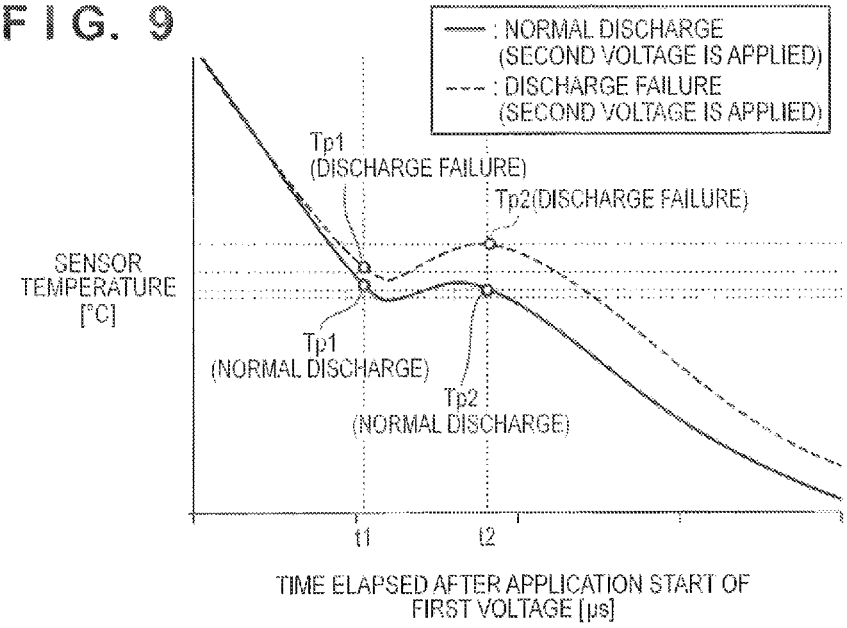
FIG. 9 is a graph showing a temporal change of the temperature detected by the temperature sensor and a determination threshold.

FIG. 9 is a graph showing a temporal change of the temperature detected by the temperature sensor and a determination threshold.

If the difference between the second temperature Tp2 and the first temperature Tp1 is equal to or smaller than a temperature difference determination threshold Tth serving as a predetermined determination threshold, it is determined that discharge is normal. If this difference is larger than the temperature difference determination threshold Tth, it is determined that discharge failure has occurred. Note that the second voltage, detection start time t1 (first time), and detection end time t2 (second time) need to be set in advance in accordance with the nozzle and a change of the temperature detected by the temperature sensor 105 along with driving.

As the ink discharge state determination method, not only the difference between Tp1 and Tp2 are compared with the threshold, but also the ratio of Tp1 and Tp2 may be compared with a predetermined threshold. If the ratio is lower than the threshold, it is determined that discharge is normal. Depending on the waveform, however, if the ratio is higher, it may be determined that discharge is normal.

Figure 10:
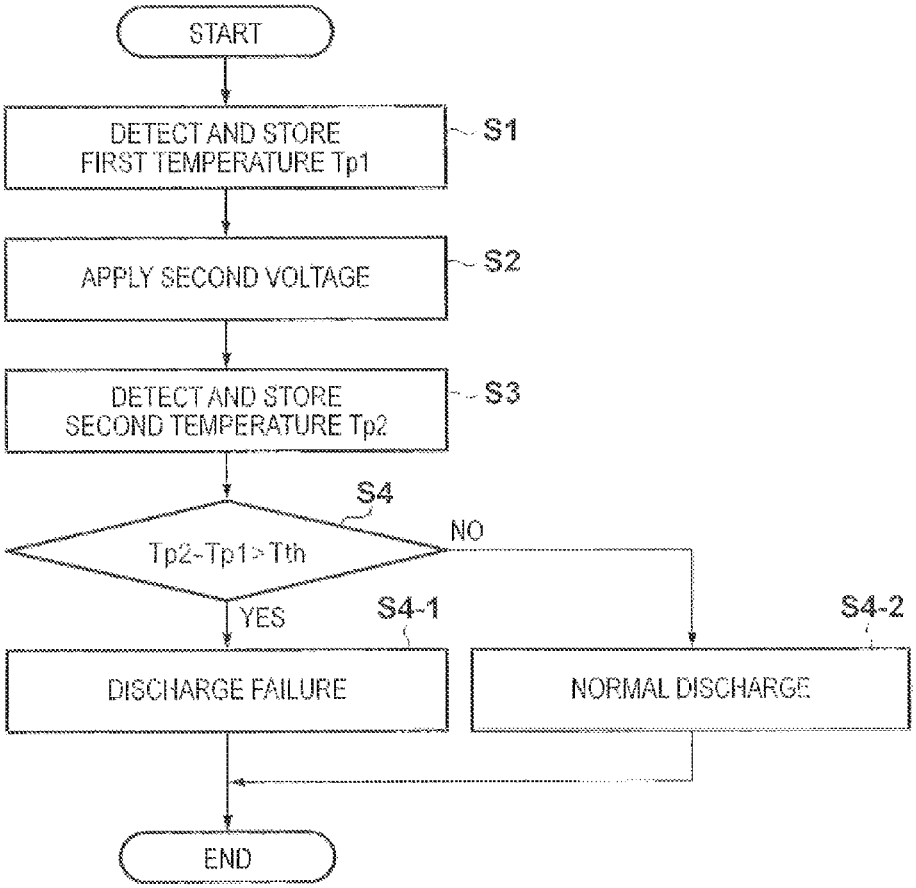
FIG. 10 is a flowchart showing ink discharge state determination processing in the first embodiment.

FIG. 10 is a flowchart showing ink discharge state determination processing in the first embodiment.

First, in step S1, the temperature sensor 105 detects the first temperature Tp1 immediately before applying the second voltage, and stores the temperature in a memory. Then, in step S2, the second voltage is applied at predetermined time. This memory is, for example, a memory arranged in a printhead 1 or a DRAM 1703.

In step S3, the temperature sensor 105 detects the second temperature Tp2 at predetermined time after applying the second voltage, and stores the temperature in the memory. In step S4, it is checked whether or not the difference between the second temperature Tp2 and the first temperature Tp1 is larger than the predetermined temperature difference determination threshold Tth. If Tp2−Tp1>Tth, the process advances to step S4-1 to determine that discharge failure has occurred. If Tp2−Tp1≤Tth (equal to or smaller than the first threshold), the process advances to step S4-2 to determine that discharge is normal.

According to the above-described first embodiment, the difference between two temperatures detected at two timings before and after applying the second voltage is compared with a predetermined threshold (first threshold). In accordance with the comparison result, it can be determined whether ink is normally discharged or discharge failure has occurred.

<Second Embodiment>

A detection timing, threshold setting, and ink discharge state determination method according to the second embodiment will be described.

Figure 11:
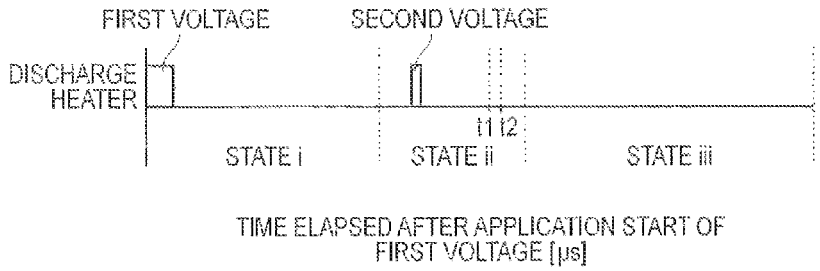
FIG. 11 is a timing chart showing timings when the second voltage is applied and a temperature sensor detects a temperature in the second embodiment.

FIG. 11 is a timing chart showing timings when the second voltage is applied and a temperature sensor detects a temperature in the second embodiment.

In the second embodiment, a temperature sensor 105 starts temperature detection immediately after applying the second voltage in the state ii. After the temperature is detected until the difference between normal discharge and discharge failure of ink is determined as a feature point, the detection ends. More specifically, as shown in FIG. 11, inspection start time t1 by the temperature sensor 105 is the timing when the difference between normal discharge and discharge failure of ink appears in the temperature detected by the temperature sensor 105 after applying the second voltage. Also, inspection end time t2 by the temperature sensor 105 is the timing when the time necessary to perform second order differential processing for a detected temperature T with respect to time t after the detection start time t1 is detected.

Figure 12:
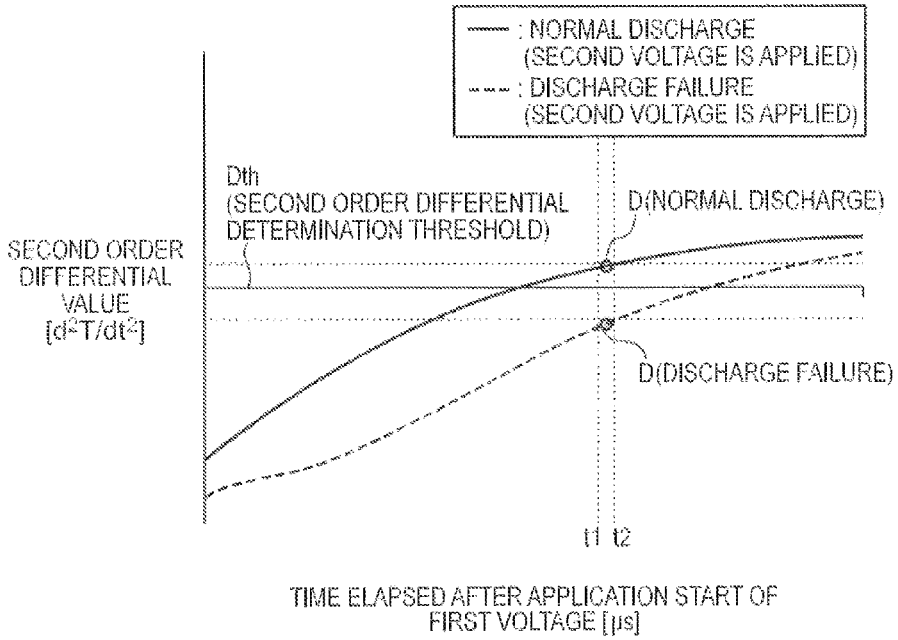
FIG. 12 is a graph showing the waveform of a second order differential value $d^2T/dt^2$ of a temperature T detected by the temperature sensor with respect to time, and a determination threshold.

FIG. 12 is a graph showing the waveform of a second order differential value $d^2T/dt^2$ of the temperature T detected by the temperature sensor as a function of time, and a determination threshold.

As already described above, a temperature change after applying the second voltage is different between normal discharge and discharge failure of ink. In normal discharge, ink covers the heater, so the temperature detected by the temperature sensor 105 abruptly drops and comes close to a constant value. Hence, the second order differential value $d^2T/dt^2$ becomes large, as shown in FIG. 12. In contrast, when discharge failure occurs, a bubble covers the heater. Thus, the temperature detected by the temperature sensor 105 gradually drops and comes close to a constant value. The second order differential value $d^2T/dt^2$ therefore becomes small.

Since the second order differential value $d^2T/dt^2$ changes depending on the difference of the discharge state, whether discharge is normal or discharge failure has occurred can be determined by comparing a second order differential value D in FIG. 12 with a second order differential determination threshold Dth.

Figure 13:
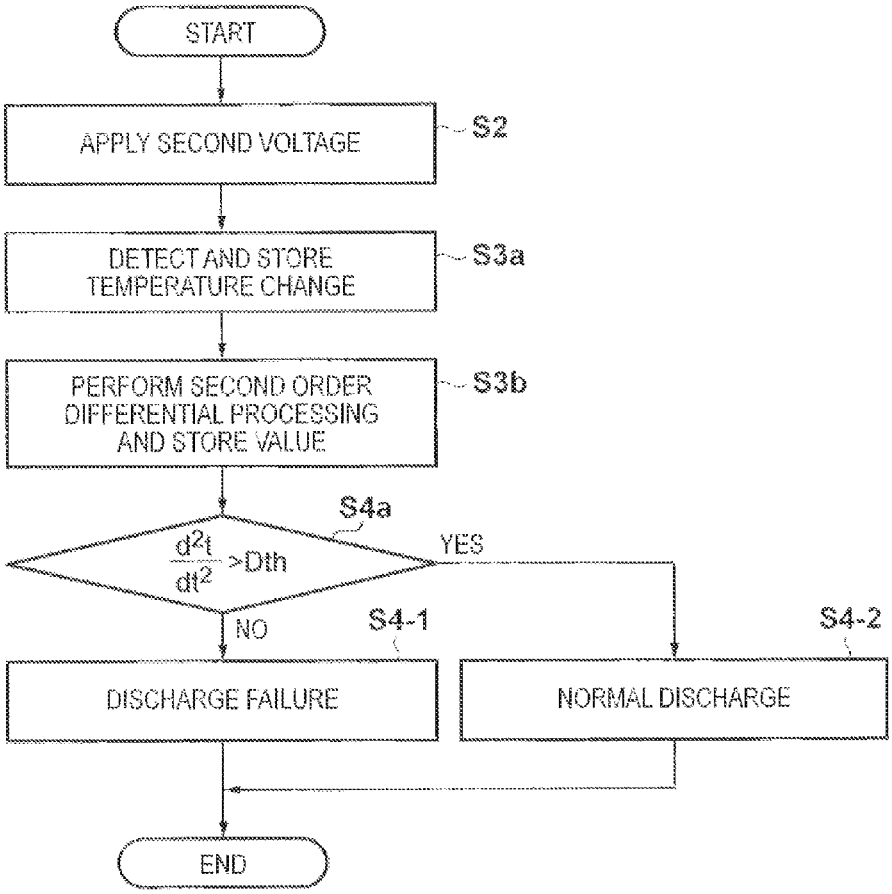
FIG. 13 is a flowchart showing discharge state determination processing in the second embodiment.

FIG. 13 is a flowchart showing discharge state determination processing in the second embodiment. In FIG. 13, the same step reference numerals as those described in the first embodiment with reference to FIG. 10 denote the same process steps, and a description thereof will not be repeated.

Referring to FIG. 13, the temperature T till the detection end time t2 of a predetermined time after the detection start time t1 a predetermined time after applying the second voltage is stored in a memory in step S3*a* after step S2. Then, in step S3*b*, the second order differential value $d^2T/dt^2$ obtained by performing second order differential for the recorded temperature is calculated to store the calculation result in the memory.

In step S4*a*, the second order differential value obtained in step S3*b* is compared with the second order differential determination threshold Dth. If $d^2T/dt^2$>Dth, it is determined that discharge is normal. If $d^2T/dt^2$≤Dth (equal to or smaller than the second threshold), it is determined that discharge failure has occurred.

Note that this determination may be made not only based on the second order differential value of the temperature as a function of time, but also based on a first order differential value. If the value is larger than the threshold, it is determined that discharge is normal. Depending on the waveform, however, if the value is smaller, it may be determined that discharge is normal.

According to the above-described second embodiment, a first order differential value or second order differential value obtained from a temperature recorded in an interval between two times after applying the second voltage is compared with a predetermined threshold (second threshold). In accordance with the comparison result, it can be determined whether ink is normally discharged or discharge failure has occurred.

The determination method is not limited to those described in the first and second embodiments, and can use any other parameter or variable as long as it concerns a detected temperature capable of clearly discriminating the difference between normal discharge and discharge failure of ink.

According to the above-described two embodiments, determination of the ink discharge state can be performed for all nozzles at appropriate timings. For example, this can be executed during the printing operation or in preliminary discharge. In any case, determination of the ink discharge state is executed along with the discharge operation of each nozzle, and a nozzle in which discharge failure has occurred can be identified at high accuracy.

Also, recovery processing can be executed quickly in response to detection of discharge failure, or an operation of complementing printing by another nozzle can be executed quickly. Further, decision of an optimum driving pulse, protection processing for the printhead from a temperature rise or the like, a warning to the user, and the like can also be executed quickly.

An example in which the present invention is applied to the printing apparatus configured to perform serial printing has been explained. Needless to say, the present invention is applicable to even a printing apparatus using a full-line printhead. In this printing apparatus, the printing operation is very fast, and it is impossible to position the printhead to the recovery unit during a series of printing operations and perform recovery processing. The present invention is therefore effective in quickly identifying a nozzle in which discharge failure has occurred during preliminary discharge to the cap or the printing operation, and quickly performing recovery processing or complementary printing by another full-line printhead.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-078092, filed Apr. 3, 2013, which is hereby incorporated by reference herein in its entirety.

What is claimed is:

1. A printing apparatus comprising:

a printhead including a heater configured to generate heat energy for discharging ink, and a temperature sensor configured to detect a temperature;

a driving unit configured to drive the heater;

a control unit configured to control to drive the heater by said driving unit by applying a first voltage for discharging ink, and drive the heater by applying a second voltage insufficient to discharge the ink after the application of the first voltage;

a first comparison unit configured to compare with a predetermined first threshold, a difference between a first temperature detected by the temperature sensor at a first time before applying the second voltage and a second temperature detected by the temperature sensor at a second time after applying the second voltage, or a ratio value of the first temperature and the second temperature; and a determination unit configured to determine that discharge failure has occurred when the difference between the second temperature and the first temperature or the ratio value is larger than the predetermined first threshold, and determine that discharge is normal when the difference between the second temperature and the first temperature or the ratio value is not larger than the predetermined first threshold.

2. The apparatus according to claim 1, further comprising:

a record unit configured to record the temperature detected by the temperature sensor in an interval between a first time after applying the second voltage, and a second time when a feature point of a change of the temperature detected by the temperature sensor can be determined;

a calculation unit configured to calculate, with respect to time, a first order differential value or second order differential value of the temperature detected by the temperature sensor that is recorded by said record unit; and a second comparison unit configured to compare the first order differential value or second order differential value calculated by said calculation unit with a predetermined second threshold, wherein said determination unit determines that discharge is normal when the first order differential value or the second order differential value is larger than the predetermined second threshold, and said determination unit determines that discharge failure has occurred when the first order differential value or the second order differential value is not larger than the predetermined second threshold.

3. The apparatus according to claim 2, wherein the feature point includes a point at which a difference between the normal discharge and the discharge failure of ink appears in the change of the temperature detected by the temperature sensor.

4. The apparatus according to claim 1, wherein said printhead includes a plurality of heaters in correspondence with a plurality of nozzles for discharging ink, and said printhead includes a plurality of temperature sensors in correspondence with the heaters.

5. The apparatus according to claim 4, wherein the application of the second voltage by said control unit and the determination by said determination unit are performed for the respective nozzles.

6. The apparatus according to claim 5, wherein said printhead includes a full-line printhead.

7. The apparatus according to claim 5, further comprising a scan unit configured to reciprocally scan a carriage on which said printhead is mounted.

8. An ink discharge state determination method in a printing apparatus including a printhead including a heater configured to generate heat energy for discharging ink and a temperature sensor configured to detect a temperature, and a driving unit configured to drive the heater, comprising:

controlling to drive the heater by the driving unit by applying a first voltage for discharging ink, and to drive the heater by applying a second voltage insufficient to discharge the ink after the application of the first voltage;

comparing with a predetermined first threshold, a difference between a first temperature detected by the temperature sensor at a first time before applying the second voltage and a second temperature detected by the temperature sensor at a second time after applying the second voltage, or a ratio value of the first temperature and the second temperature;

determining that discharge failure has occurred when the difference between the second temperature and the first temperature or the ratio value is larger than the predetermined first threshold; and determining that discharge is normal when the difference between the second temperature and the first temperature or the ratio value is not larger than the predetermined first threshold.

9. The method according to claim 8, further comprising:

recording the temperature detected by the temperature sensor in an interval between a first time after applying the second voltage, and a second time when a feature point of a change of the temperature detected by the temperature sensor can be determined;

calculating, with respect to time, a first order differential value or second order differential value of the recorded temperature detected by the temperature sensor; and comparing the calculated first order differential value or second order differential value with a predetermined second threshold, wherein it is determined that discharge is normal when the first order differential value or the second order differential value is larger than the predetermined second threshold, and it is determined that discharge failure has occurred when the first order differential value or the second order differential value is not larger than the predetermined second threshold.

10. The method according to claim 9, wherein the feature point includes a point at which a difference between the normal discharge and the discharge failure of ink appears in the change of the temperature detected by the temperature sensor.

11. The method according to claim 8, wherein the printhead includes a plurality of heaters in correspondence with a plurality of nozzles for discharging ink, the printhead includes a plurality of temperature sensors in correspondence with the heaters, and the application of the second voltage and the determination are performed for the respective nozzles.

* * * * *